United States Patent [19]

Milligan et al.

[11] Patent Number: 5,016,329

[45] Date of Patent: May 21, 1991

[54] APPARATUS FOR COMPRESSIVE SHRINKAGE OF TUBULAR KNITTED FABRICS AND THE LIKE

[75] Inventors: William D. Milligan, Matthews, N.C.; Andrew P. Cecere, Valley Stream, N.Y.

[73] Assignee: Compax Corp., Lexington, N.C.

[21] Appl. No.: 421,127

[22] Filed: Oct. 13, 1989

Related U.S. Application Data

[60] Division of Ser. No. 334,785, Apr. 6, 1989, now U.S. Pat. No. 4,802,819, which is a continuation of Ser. No. 107,953, Oct. 13, 1987, abandoned.

[51] Int. Cl.[5] ..... D06C 21/00; D06C 23/04; D06C 29/00

[52] U.S. Cl. ..... 26/18.5; 26/18.5

[58] Field of Search ..... 26/18.6, 18.5

[56] References Cited

U.S. PATENT DOCUMENTS

| | | | |
|---|---|---|---|
| 2,310,664 | 2/1943 | Mason | 26/18.6 |
| 3,015,145 | 1/1962 | Cohn | 26/18.6 |
| 3,015,146 | 1/1962 | Cohn | 26/18.6 |
| 3,083,435 | 4/1963 | Cohn | 26/18.6 |
| 3,431,608 | 3/1969 | Reiners | 26/18.6 |
| 3,471,907 | 10/1969 | Beckers | 26/18.6 |
| 3,973,303 | 9/1976 | Diggle Jr. | 26/18.6 |
| 4,689,862 | 10/1987 | Catallo | 26/18.6 |
| 4,882,819 | 11/1989 | Milligan | 26/18.6 |

FOREIGN PATENT DOCUMENTS

| | | | |
|---|---|---|---|
| 1237528 | 10/1959 | France | 26/18.6 |

OTHER PUBLICATIONS

Compax-Catalog 1973.

*Primary Examiner*—Werner H. Schroeder
*Assistant Examiner*—Bibhu Mohanty
*Attorney, Agent, or Firm*—Schweitzer, Cornman & Gross

[57] ABSTRACT

An apparatus for compressive lengthwise shrinking of tubular knitted fabrics and other materials, particularly in a single stage. Feeding and retarding rollers are separated from each other by a distance significantly greater than the thickness of the fabric. Zone-forming blades are projected between the rollers from opposite sides and form between them a confinement zone which extends at a large angle from the feeding roller to the retarding roller. Fabric is guided to the zone under low contact pressure by the feeding roller and is conveyed away from the zone under similarly low contact pressure by the retarding roller. At the entrance to the zone, the fabric is decelerated and compacted lengthwise without burnishing or abrasion and without crimping. Tubular and open width knitted fabrics can be compressively preshrunk in large amounts, up to 25% and more, in a single stage. Significant savings and other benefits are realized.

14 Claims, 5 Drawing Sheets

APPARATUS FOR COMPRESSIVE SHRINKAGE OF TUBULAR KNITTED FABRICS AND THE LIKE

RELATED APPLICATIONS

This application is a division of our co-pending application Ser. No. 334,785, filed Apr. 6, 1989, now U.S. Pat. No. 4,802,819. Said co-pending application was a continuation of our earlier application Ser. No. 107,953, filed Oct. 13, 1987, now abandoned.

BACKGROUND AND SUMMARY OF THE INVENTION

The invention is directed to improved apparatus for the compressive shrinkage of fabrics. The invention is applicable to particular advantage to the treatment of tubular knitted fabrics, but is not to be considered as limited thereto, as the principles of the invention are useful to advantage in connection with the processing of open width fabrics of both knitted and non-knitted construction.

In the processing of knitted fabrics, particularly tubular knitted fabrics, one of the widely utilized and commercially successful procedures for compressive shrinkage treatment is reflected in the Eugene Cohn, et al. U.S. Pat. Nos. 3,015,145, 3,015,146 and 3,083,435. These procedures involve one or, more typically, two compressive shrinking stations, each comprising an opposed pair of rollers and a feeding and confining shoe. Incoming fabric is passed between a feeding roller and a confining shoe, causing the fabric to be advanced at a predetermined speed in a relatively positive manner. The second roller, referred to as a retarding roller, forms a nip with the feeding roller, such that fabric, after it exits from the confining shoe, is engaged under pressure simultaneously between the feeding and retarding rollers. The retarding roller, which is driven at a surface speed controllably slower than the surface speed of the feeding roller, retards the advance of the fabric, so that controlled lengthwise compression of the fabric takes place in a short compressive shrinking zone formed between the roller nip and the terminating edge of the fabric confining shoe. The shoe and/or rollers desirably are heated, such that the emerging fabric retains a substantial portion, at least, of the compressive shrinkage imparted thereto in the compressive shrinkage zone.

Even though the above described compressive shrinking techniques have been extremely successful commercially, there are certain inherent limitations thereto which result from the fact that the fabric is being acted upon simultaneously, at the same point but on opposite sides, by rollers operating at different speeds. The opposite sides of the fabric are thus necessarily treated slightly differently. In addition, the inherent slippage of at least the feeding roller relative to the fabric surface at the roller nip sometimes imparts an undesirable surface appearance to certain types of fabrics, such as by lightening darker shades of outerwear fabric, for example, or imparting a shine to underwear fabrics. This can be disconcerting particularly with respect to the processing of tubular fabrics, where the "opposite" sides of the fabric during processing are in fact the same surface of the fabric—namely the outside surface—in the finished garment.

For most applications, the tendency of a single compressive shrinking station of the above described type to have an asymmetrical effect on opposite sides of the fabric is accommodated by providing for dual station machines, with one compressive shrinking station being reversely oriented with respect to the other. This provides acceptable results for some fabrics, for example, but still has shortcomings with respect to highly sensitive fabrics, such as dark shades of outerwear fabrics.

In accordance with the present invention, improved equipment and techniques are provided for the mechanical compressive shrinkage of fabrics, particularly but not necessarily tubular knitted fabrics, which enable the many important advantages of the differential roller processing technique to be employed yet which significantly minimizes or eliminates certain inherent limitations in the existing procedures. More specifically, the apparatus of the invention utilizes opposed feeding and retarding rollers, driven respectively at higher and lower surface speeds, for feeding and retarding fabric. However, in contrast to the equipment of the above described patented construction, the respective feeding and retarding rollers are separated by a distance significantly greater than the thickness of the fabric being processed, so that the fabric cannot be engaged simultaneously on opposite sides by the respective rollers. A fabric confining shoe (entry shoe) is associated with the feeding roller, and a separate confining shoe (exit shoe) is associated with the retarding roller. The extremities of these respective entry and exit shoes form between them a defined confinement zone. The fabric is decelerated and longitudinally compressed at the entrance to the zone speed, and confined and guided for a controlled dwell time during its passage through the zone.

To particular advantage, the opposed extremities of the respective confining shoes are located substantially at the point of maximum convergence of the respective feeding and retarding rollers and are disposed at a substantial angle, such as 45 degrees, to the surface of the feeding roller. Accordingly, as the fabric exits the discharge end of the entry shoe, it is abruptly diverted by the leading end of the exit shoe and is guided into the confinement zone, defined between the two shoes. Upon exiting the confinement zone, the fabric is immediately contacted by the outer surface of the retarding roller, travelling at a controllably slower surface speed than the feeding roller.

Significantly, although the feeding and retarding rollers are operated at controllably different surface speeds, the rollers do not act simultaneously upon opposite surfaces of the fabric at the same point, so that it is not necessary for the roller surfaces to have any significant slippage with respect to the fabric surfaces. As a result, it is possible under the present invention to impart the high degree of mechanical compressive shrinkage, required by many knitted fabrics, in a single station machine.

To advantage, fabric passing through the confinement zone is confined under only minimum pressures, in the thickness direction. This is accomplished by providing for a precision, on-the-fly adjustment mechanism for movably positioning one of the shoes, preferably the entry shoe, for limited motion about a pivot axis. This accommodates variation in the thickness of the confining zone during normal operations of the apparatus. The confining pressures acting on the fabric in the zone are maintained at a level sufficient to avoid crimping of the longitudinally compressed fabric, but typically not significantly greater than that.

In one of its particularly preferred embodiments, apparatus of the invention has substantial compatibility, structurally, with the equipment heretofore marketed under the above mentioned United States patents, and with respect to which there is a substantial installed base of equipment. The apparatus of the invention is capable of being incorporated by a relatively simple retrofit into the existing installed equipment, utilizing much of the existing mechanism, resulting in significant upgrading in performance of the equipment for at least certain types of fabrics.

For a more complete understanding of the above and other features and advantages of the invention, reference should be made to the following description of a preferred embodiment and to the accompanying drawings.

DESCRIPTION OF A PREFERRED EMBODIMENT

Figure 1:
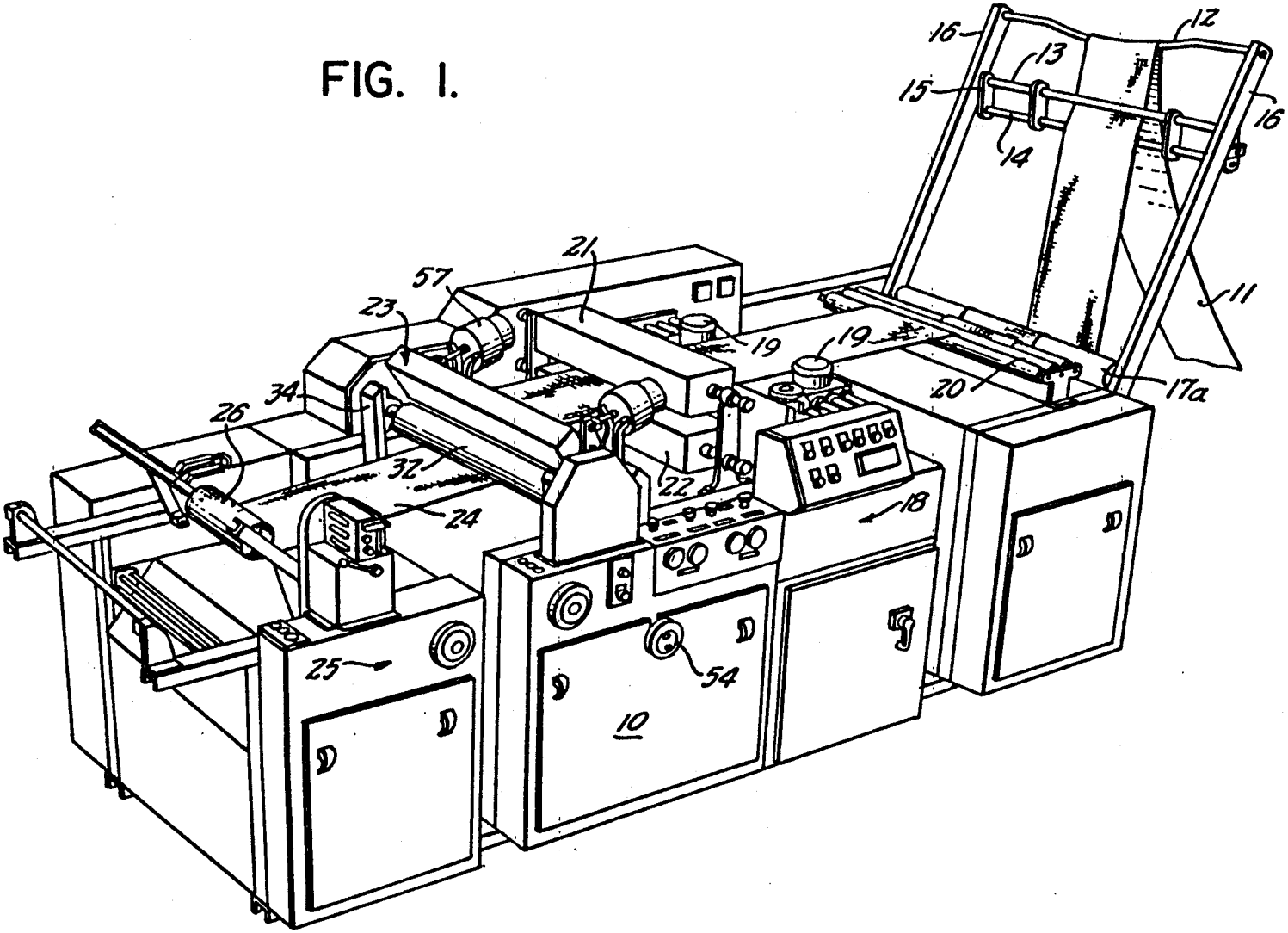
FIG. 1 is a perspective view of a complete range incorporating the compressive shrinkage apparatus of the invention, intended particularly for the mechanical compressive shrinkage of tubular knitted fabric.

Referring now to the drawings, and initially to FIG. 1, the reference numeral 10 designates in a general way a processing range for treating tubular knitted fabric. Unprocessed fabric 11 from a supply source (not shown) such as a pallet or truck, is passed upwardly over a rotatable bow 12, which spreads the fabric to a generally flat, two layer form. The fabric is then passed under a first tension bar 13 and over a second tension bar 14. The tension bars 13, 14 are separated by spacers 15, and are mounted on frame members 16 for controlled rotational positioning. The tension bars serve to apply a very light tension to the fabric, sufficient to flatten and control it, but typically insufficient to elongate it to any significant degree.

In the illustrated range, fabric is directed around a guide roller 17 (FIG. 7), over a driven, variable speed control roller **17*a*, around a floating dancer roll 17*b* and then through a series of flattening rolls 20. The control roller 17*a* provides the means for drawing the unprocessed fabric 11 over the bow 12 and through the tension bars 13, 14. The speed of the roller 17*a* is controlled by the dancer roll 17*b*** with reference to the operating speed of other components of the range, as will be further explained.

Downstream of the control roller **17*a* is a propeller-spreader station, generally designated by the numeral 18**. By way of example but not of limitation, the propeller-spreader apparatus may be of the type illustrated in the Frezza U.S. Pat. No. 4,103,402, the disclosure of which is incorporated herein by reference.

The spreader apparatus includes an internal spreader frame (not shown) which is received internally of the fabric tube. The spreader frame is supported horizontally by means of grooved edge drive rolls 19, which are adjustable laterally to the width of the spreader frame and which are driven externally by the machine motive system. The spreader frame assembly, which is in itself well known and widely utilized in the trade, extends from a series of flattening rolls 20, at its upstream extremity, through a pair of steam boxes 21, 22 on the downstream side of the edge drive rolls 19, substantially to the entry or feeding roll (to be described) of a compressive shrinkage station 23.

In accordance with known techniques, the incoming fabric may be slightly overfed onto the downstream section of the spreader frame (i.e., downstream of the edge drive rolls 19) so as to be effectively relaxed in a lengthwise direction and set to a predetermined, uniform width. In this condition, the fabric is subjected to steam when passing between the steam boxes 21, 22, which serves to moisten and lubricate the fibers of the material and accommodate relaxation and adjustment of the stitches, in preparation for the primary compressive shrinkage treatment.

Immediately upon discharge from the spreader frame section 18, the fabric enters the compressive shrinkage station 23 where, in the manner to be more fully described, it is compressed in a lengthwise direction in a controllable amount which typically is a function of the inherent residual shrinkage of the incoming fabric. In the case of tubular knitted fabrics, this may well be on the order of 15–25%, for example. The longitudinally compressed fabric, now designated by the reference number 24, is advanced to a gathering station 25 which, in the illustrated range, is a roll-up mechanism. By way of example, the roll-up apparatus may be of the general type shown in the Eugene Cohn et al. U.S. Pat. No. 3,606,186 and/or the Samuel Cohn et al. U.S. Pat. No. 2,736,098, the disclosures of which are incorporated herein by reference. The fabric, passing to the roll-up device 25, is kept under minimum tension, sufficient only for adequate control of the fabric during the winding of the roll 26.

Alternatively, the fabric may be directed to a folder apparatus such as; for example, of the type disclosed in the Frezza U.S. Pat. No. 4,053,151.

Figure 7:
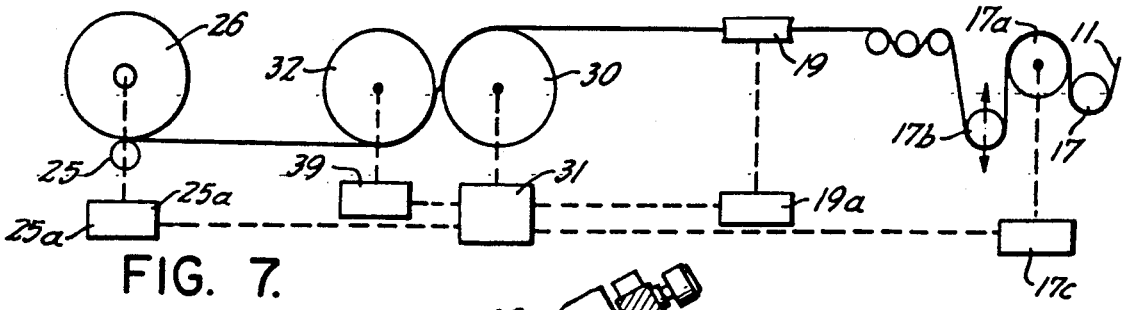
FIG. 7 is a simplified schematic representation of a drive control system for the apparatus of FIG. 1.

The drive mechanisms for the range of FIG. 1 are illustrated schematically in FIG. 7. Individually speed controlled drive arrangements are provided for the gathering station 25, the compressive shrinkage station 23, the spreader-propeller station 18 and the entry roll **17*a*. These may be in the form of individually controllable variable speed motors for each of these major sections of the range, or the system may be driven by a primary, speed controllable drive motor 31 in conjunction with variable speed mechanical drives for effecting desired speed control. Typically, one of the stations, such as the compressive shrinkage station 23, is a "master" station, driven by a motor 31 and with respect to which the operating speeds of the other stations are automatically slaved. For example, the driven entry roller 17*a*, the edge drive rolls 19, and the wind up device 25 are respectively driven from the master drive motor 31 through adjustable variable speed mechanisms 17*c*, 19*a* and 25*a*. The variable speed mechanism 17*c* is controlled by the dancer roll 17*b*, so as to maintain a constant fabric supply to the propeller-spreader apparatus 18. Under the described arrangement, if the compressive shrinkage station 23 were increased in speed 10%, the speeds of all stations of the range automatically would increase by an equivalent amount. If the speed of the roll-up station 25 were changed, on the other hand, it would be increased or decreased relatively to the speed of the compressive shrinkage station 23**, and the other stations would be unaffected. These techniques are, of course, well known in the art.

With reference now to FIGS. 2–7, illustrating details of the novel compressive shrinkage station of the invention, the apparatus includes a skeletal frame structure 27 (FIG. 3) on which are mounted bearing supports 28, at opposite sides of the machine, carrying bearing blocks 29. The bearing blocks 29 rotatably journal a feeding roller 30. In the illustrated arrangement, the feeding roller 30 may be mounted on a fixed axis on the machine frame 27 for controlled rotation by means of a variable speed master drive 31 (FIG. 7).

Cooperating with the feeding roller 30 is a retarding roller 32. This is journalled on opposite sides by means of bearing blocks 33 carried by opposite side members 34 of a pivot frame, mounted in the machine frame 27 for pivoting about the axis of a drive shaft 35. The frame members 34 are connected to the rod ends 36 of fluid actuators 37 anchored at 38 in each side of the machine frame. Desirably, the fluid actuators 37 are one-way actuators, being spring urged to extend the actuating rods 36 toward the left in FIG. 3 and being actuatable, under regulated fluid pressure to retract the actuator rods and thereby draw the retarding roller 32 toward the feeding roller 30.

A variable speed mechanical drive 39 (FIG. 7), operated from the master drive 31, serves to drive the retarding roller 32 at a controllably lesser surface speed than the surface speed of the feeding roller 30. The drive 39 may operate a sprocket 40 (FIG. 3) and through a chain or belt 41 a further sprocket 42 mounted on the shaft 35 about which the roller mounting frame 34 is pivoted. A further chain or belt drive (not illustrated) connects the shaft 35 to the retarding roller 32, enabling the retarding roller to be controllably driven in any pivoted position of the frame 34.

In the illustrated and preferred embodiment of the invention, the feed roller 30 may have an overall diameter of approximately five inches. The roller is of hollow construction, having a relatively heavy outer steel cylindrical wall 43 of approximately one and one quarter inches in thickness. Desirably, this is roughened on the exterior surface for enhanced gripping of the incoming fabric 11. The feed roller cooperates with a confining shoe assembly 44, hereinafter referred to as the shoe, which comprises a main shoe body 45 and a zone-forming blade 46. The shoe body 45 and blade 46 form, in effect, a single shoe assembly provided with smooth cylindrical inner surface portions 47, 48. These cylindrical surface portions are of just slightly larger diameter than that of the feeding roller 30 (e.g., about 0.04 inch on a five inch nominal roll diameter), and the center of the cylindrical surface 47–48 may be located slightly offset (to the right in FIG. 2) from the center of the roller, providing a gradually tapered confining slot 49 for guiding and confining the incoming fabric 11 over a substantial arcuate portion of the feed roller 30 (i.e. about 90 degrees) to the discharge end of the shoe assembly.

To particular advantage, the mounting arrangement for the entry shoe assembly 44 may be substantially in accordance with the Edmund A. Diggle, Jr. U.S. Pat. No. 3,973,303, the disclosure of which is incorporated herein by reference. That mechanism includes a pair of upwardly extending brackets 50 mounted for limited rotation on the end shafts 51 of the feed roller 30. These brackets are connected by way of a swivel coupler 52 to a vertically adjustable rod 53 controllably positionable by the machine operator, as through a hand wheel 54 (see FIG. 1). With limited vertical adjustment of the rods 53, the supports 50 may be caused to pivot slightly in a clockwise or counterclockwise direction about the axis of the shaft 51, providing a high precision adjustment of the position of the entry shoe.

L-shaped brackets 55 are pivotally mounted at 56 on the upwardly projecting brackets 50, and are controllably pivotable relative to the upstanding brackets by means of single-acting air cylinders 57 at each side. When deactivated, the actuators 57 are spring urged in a retracting direction, to pivot the L-shaped supports 55 in a clockwise direction as viewed in FIG. 3. Under regulated air pressure, the operating rods 58 of the actuators are extended, pivoting the supports 55 in a counterclockwise direction.

Mounted on the supports 55 by means of a pivot bearing 59 at each end, is the entry shoe assembly 44. The shoe assembly includes tilt adjustment lugs 60 at each side, which project through windows 61 in the support members 55, being adjustably positioned within such windows by means of adjusting bolts 62, 63.

Figure 2:
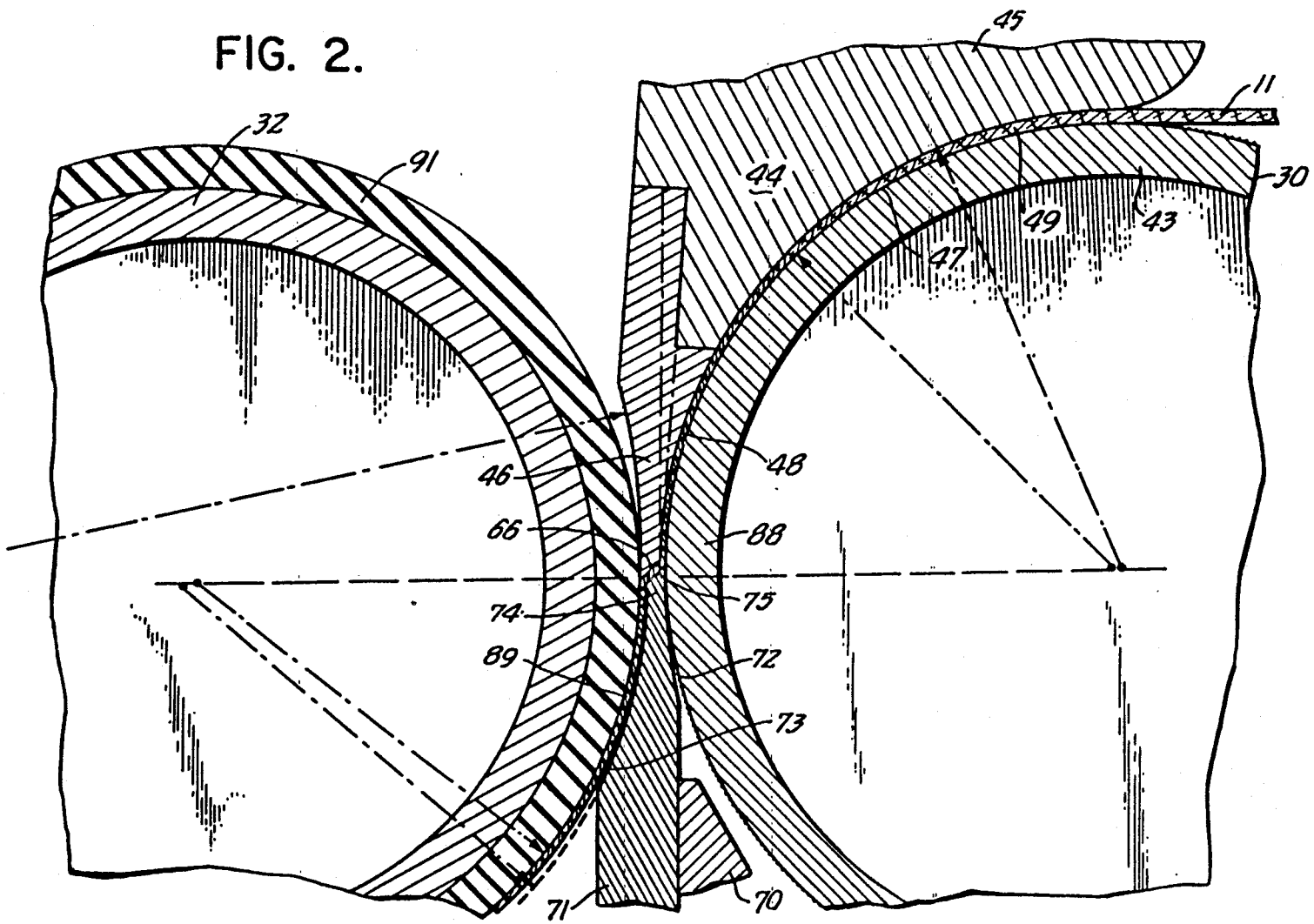
FIG. 2 is a highly enlarged, cross sectional view of the compressive shrinkage station of the apparatus of FIG. 1, showing the respective feeding and retarding rollers and the respective entry and exit confining shoes.
Figure 3:
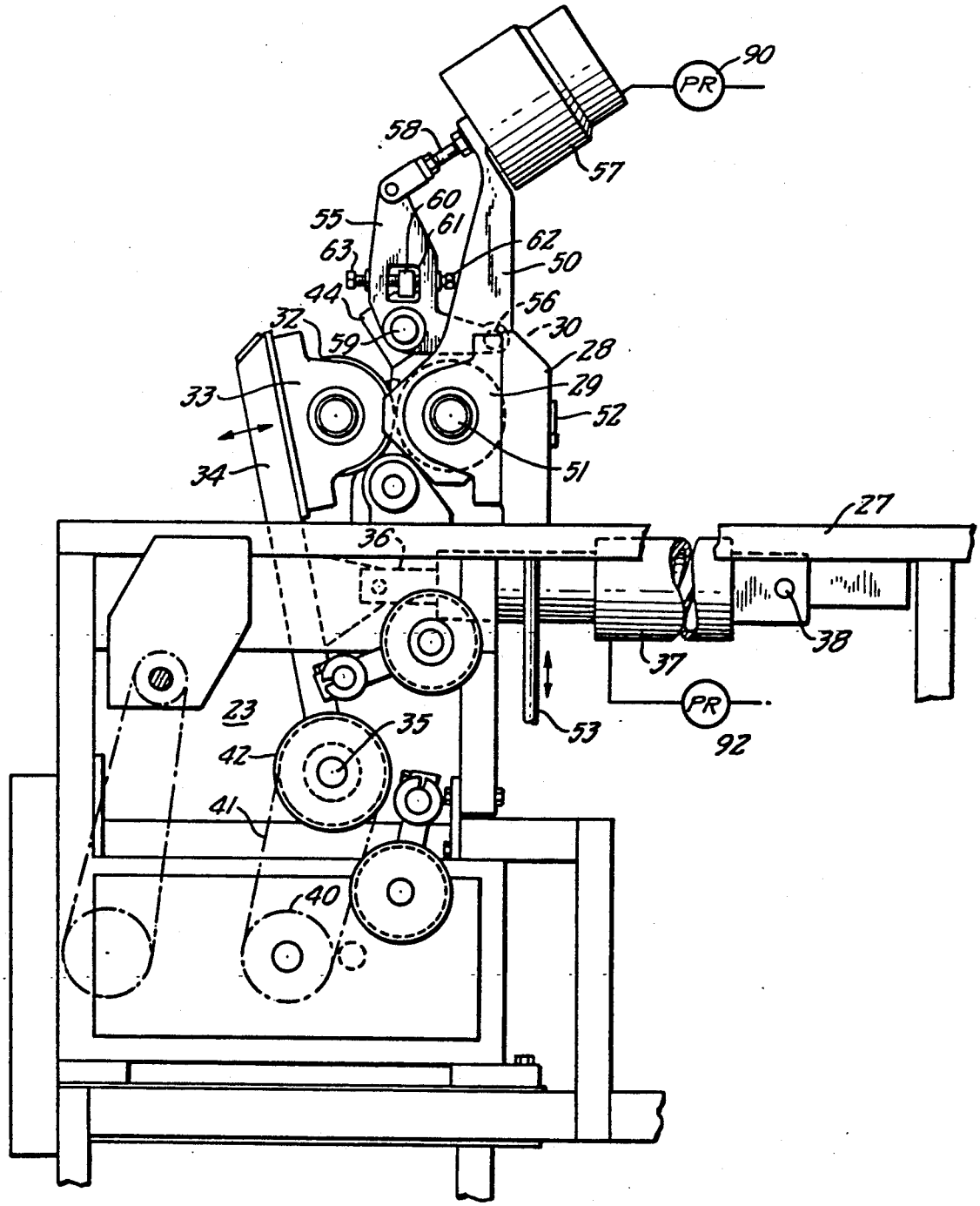
FIG. 3 is a representational side elevational view of a portion of the apparatus of FIG. 1, showing particularly structural details of the compressive shrinkage station.

To understand the operation of the mounting bracket assembly for the entry shoe, assume that the shoe assembly 44 is in an initial position as shown in FIG. 2. By adjusting the bolts 62, 63, the entire shoe assembly 44 may be tilted about the axis of the pivot bearing 59 as necessary to adjust the configuration of the gradually converging confinement space 49. The entire assembly may be pivoted circumferentially about the axis of the feed roller 30, by vertical adjustment of the shafts 53, causing the upright brackets 50 to pivot about the roller shaft. This provides for a fine adjustment of the positioning of the lower extremity of the feeding shoe assembly and thus the thickness of the confinement zone. Bodily retraction of the entire feeding shoe assembly from the region of the roller nip, between the feeding and retarding rollers 30, 32 is accomplished by deactivating the air actuators 57, pivoting the L-shaped supports 55 clockwise about the axis 56. This may be done to open up the working area of the compressive shrinking station, to facilitate initial threading of a length of fabric into the machine.

Significantly to the invention, the zone-forming blade 46 does not taper gradually to a fine point, as is the case in the existing mechanical compressive shrinkage equipment of the type described in the before mentioned Eugene Cohn et al. patents. Rather, the zone-forming blade has a substantial thickness at its lower extremity. In a typical machine, for the processing of a wide range of tubular knitted fabrics in widths of up to fifty inches, the blade thickness at its extremity may be approximately 0.12 inch. Also significantly, the bottom surface 66 of the zone-forming blade extends downward and away from the surface of the feed roller 32 at a relatively abrupt angle, in the illustrated apparatus at a nominal angle of about 45 degrees. This angled surface 66 forms one side of a confinement zone, as will be more fully described.

Figure 5:
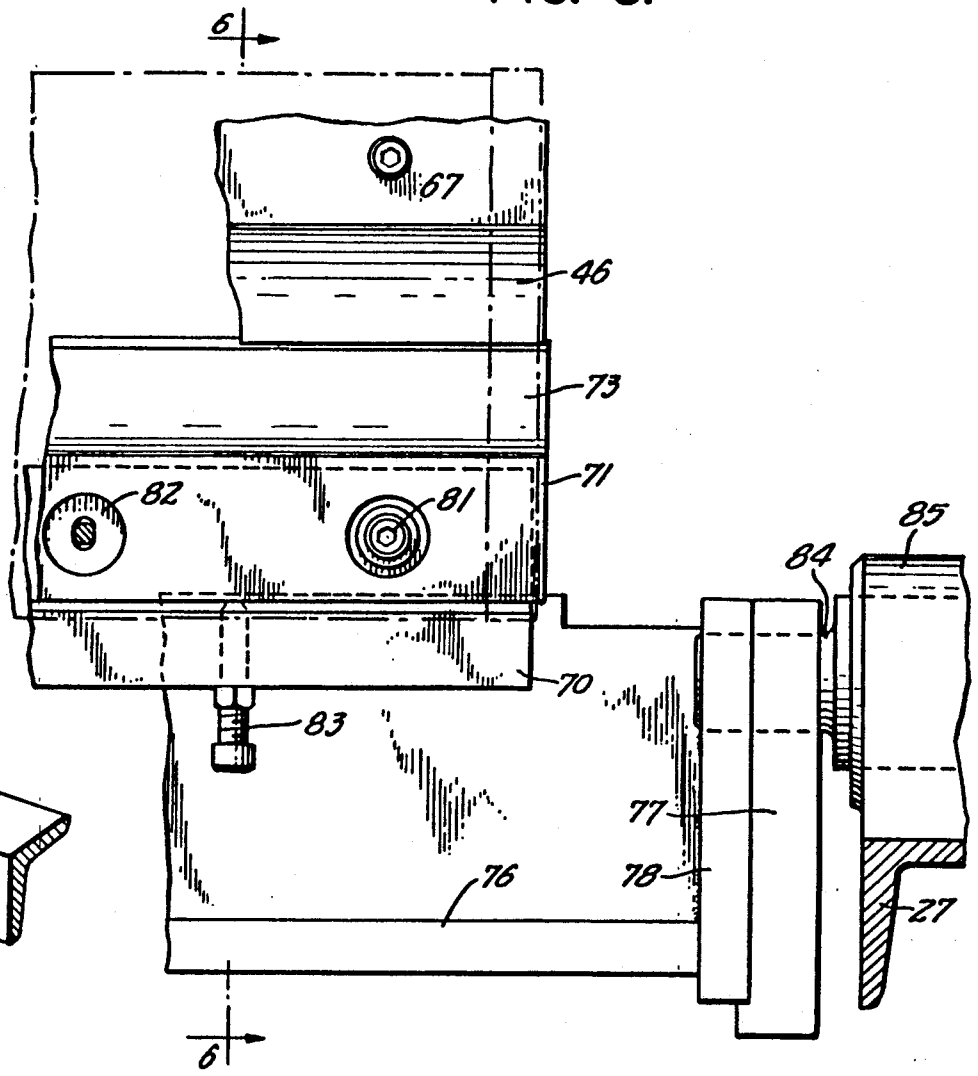
FIG. 5 is a fragmentary front elevational view showing details of the exit and entry confining shoes.
Figure 4:
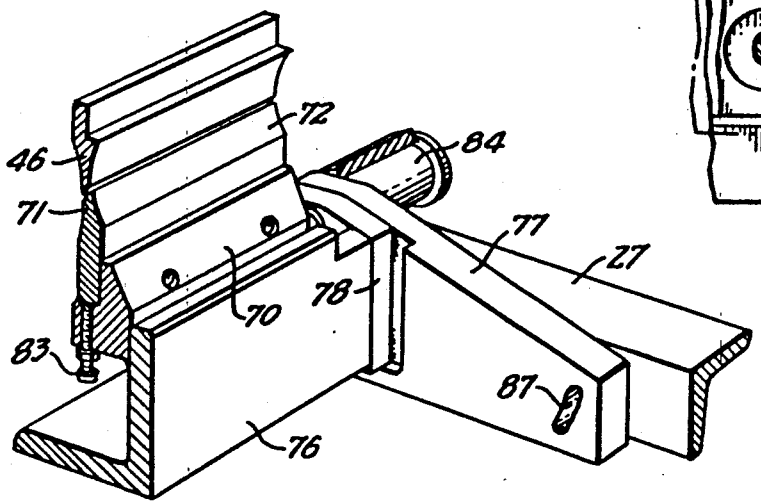
FIG. 4 is a fragmentary perspective view, showing portions of the entry and exit confining shoes and details of the mounting means for the exit confining shoe.
Figure 6:
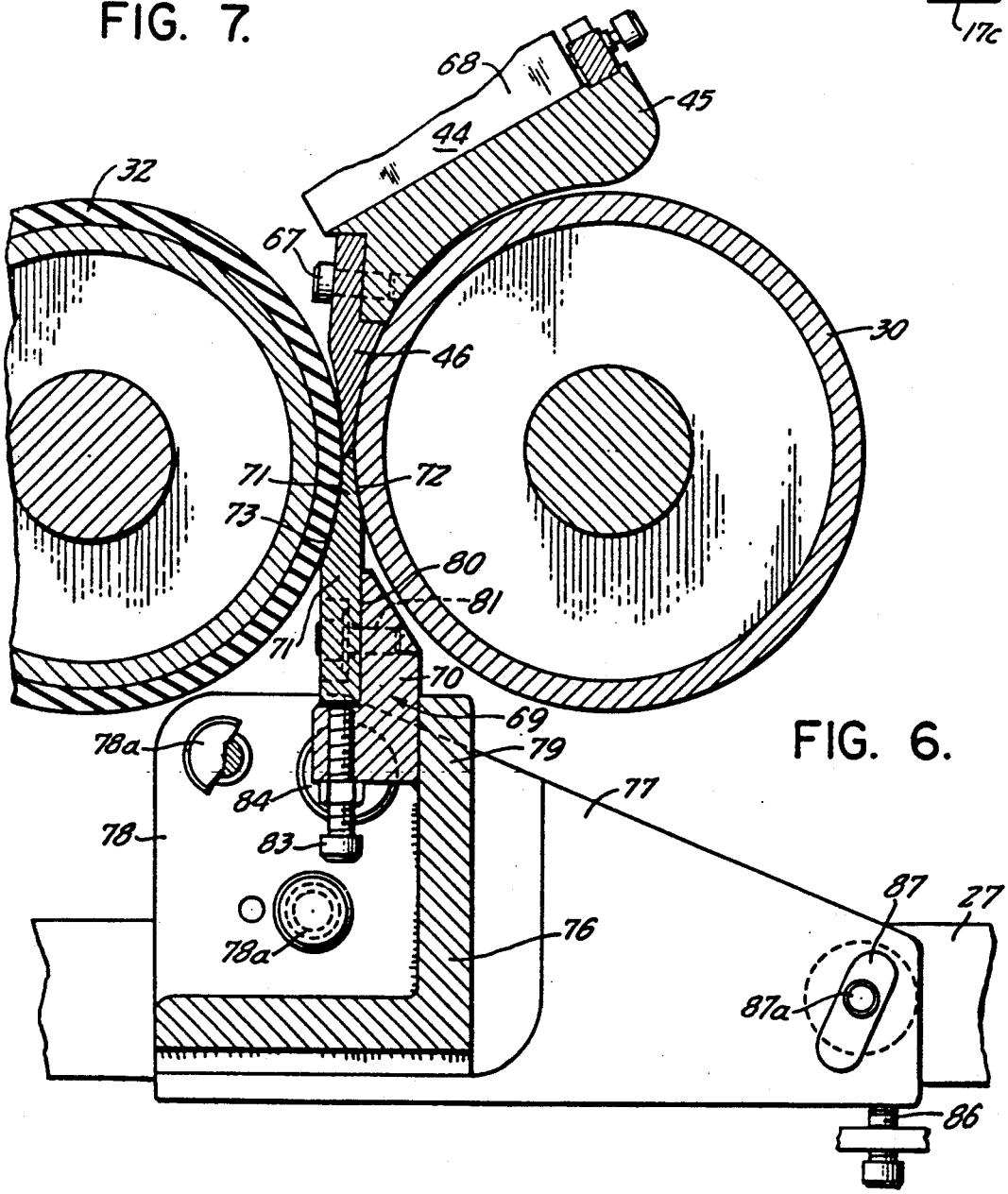
FIG. 6 is a cross sectional view as taken generally on line 6—6 of FIG. 5.

The zone-forming blade 46 typically is secured to the body 45 of the entry shoe by means of a plurality of bolts 67, spaced across the width of the blade (see FIGS. 5 and 6). The shoe body 45 itself may comprise a plurality of shoe segments, individually adjustable with respect to a mounting beam 68, to enable precision final adjustment of the zone-forming blade 46.

Mounted directly below the entry shoe 44 is an exit shoe assembly 69 comprising a shoe body 70 and a zone-forming blade 71. The blade 71, as the blade 46, is formed with front and back arcuate surfaces 72, 73 confronting surface portions of the respective feeding and retarding rollers 30, 32. At least the back arcuate surface 73 approximately conforms to the surface contours of the retarding roller 73 over an arc of, say, 15–20 degrees, so as to form a gradually divergent exit path 89 for fabric being conveyed by the retarding roller. For example, the surface 73 may have a radius of about 2.50, for cooperation with a retarding roller 32 having an outside radius of approximately 2.46, with the center of radius of the surface 73 being located slightly to the left of the roll axis, as viewed in FIG. 2, to provide for the slightly divergent contours of the exit path, which are somewhat exaggerated in FIG. 2.

As is evident in FIGS. 2 and 6, the configuration of the upper end of the zone-forming blade 71 is complementary to the lower configuration of the upper blade 46. The thickness of the blade extremity 74 is substantially identical (i.e. approximately 0.12 inch in the example), and the upper zone-forming surface 75 is disposed at the same angle as the surface 66.

In the illustrated machine, adapted particularly for retrofit installation, precision mounting of the retarding shoe assembly 69 is provided by means of a large, heavy angle member 76, which is rigidly secured at each end to mounting brackets 77. The angle members may be provided with welded caps 78 at each end, which are secured to the brackets 77 by bolts 78*a*. The body portion 70 of the retarding shoe is rigidly welded to the upper leg 79 of the angle member, as shown in FIG. 6, and is provided with a recess 80 for the reception of the zone-forming blade 71. Precision adjustment of the blade is achieved by providing a large plurality of mounting bolts 81, received in vertically elongated slots 82 in the blade member. A plurality of adjusting bolts 83 extend upwardly through the shoe body 70 to engage the bottom surface of the blade 71. In a typical fifty inch machine, the tightening bolts 81 may be spaced apart approximately 2.6 inches, for example, while the vertical adjustment bolts 83 may be spaced about 5.2 inches apart, one for each pair of tightening bolts. This arrangement enables a high degree of precision to be achieved in alignment of the lower zone-forming blade 71 with respect to the upper zone-forming blade 46, for precision definition of the treating zone, defined by the respective upper and lower blade surfaces 66, 75.

In the illustrated apparatus, the angle bar assembly is pivoted on the machine frame 27 by a shaft 84 carried by the machine frame by means of a mounting block 85 at each side, which is an integral part of bearing support 28. This is a convenient mounting, as the shaft 84 and block 85 are already provided on the existing installed base of commercial machines and can be used conveniently for retrofit of such machines to incorporate the improvements of the present invention.

The location of the pivot shaft 84, with respect to the distributed weight of the angle member 76 and mounting brackets 77 is such that the assembly tends to pivot by gravity in a clockwise direction, as viewed in FIG. 6, tending to pivot the lower zone-forming blade 71 toward the feeding shoe 30. This movement is adjustably limited to maintain a predetermined minimum spacing between the front arcuate surface 72 of the blade and the surface of the feeding shoe 30. Such adjustment may be provided by the use of shims (not shown) at the end extremities of the feed roller to limit closing movement of the blade 71, or by means such as adjusting bolts 86 engageable with the mounting brackets 77, as shown in FIG. 6. Desirably, pivoting movement of the blade mounting in the opposite or counterclockwise direction may be unrestricted within limits to facilitate clearing the machine. For this purpose, the outer ends of the bracket 77 may be provided with elongated slots 87 in which are received limiting pins 87*a*. Pivoting action of the bracket 77 is free within the limits of the elongated slot 87, subject to the positioning of the adjusting bolts 86 and/or limiting shims, and also, of course, limited by the presence of the retarding roller 32.

For the initial setup of the equipment, the zone-forming blades 46, 71 are positioned such that their angular surface extremities 66, 75 are located substantially at the point of maximum convergence of the rollers, i.e. substantially on a plane including both roller axes. The acutely angled tip 88 of the lower blade 71 is spaced very close to, but not in contact with the outer surface of the feeding roller 30. By adjustment of the vertical rods 53, the upper blade 46 is positioned with respect to the lower blade such that the zone-forming surfaces 66, 75 are spaced slightly apart and may be slightly divergent. The arcuate surface 48 of the upper blade 46 is spaced slightly from the surface of the feeding roller, and this may be assured by the provision of shims or spacing rings at the end extremities of the feeding roller, or by other limit adjustments, as will be appreciated. The upper fluid actuators 57 are charged with air under limited pressure typically in the range of slightly above zero up to above five psi, acting on pistons of about twenty square inches. The closing force available from the actuators 57, in an example fifty inch machine, is thus desirably about 200 pounds or less, which results in an applied force of a few pounds per lineal inch.

Unprocessed fabric 11, in flat form and at uniform width, enters the confined passage 49 and is advanced therethrough under very limited confining pressure, by reason of the roughened surface of the feeding roller. The fabric, either in two-layer form in the case of tubular knitted fabric, or in a single layer in the case of other fabrics, is advanced through the passage 49 at the surface speed of the feed roller 30.

Upon reaching the lower extremity of the arcuate surface 48, the fabric is abruptly diverted by the blade surface 75 into a confinement zone formed between the surfaces 66, 75, which may be divergently related by a small amount (e.g., less than one degree).

Fabric traverses the confinement zone, which in the illustrated apparatus may have a length of about 0.17 inch, until it engages the outer surface of the retarding roller 32. Thereupon it is abruptly diverted into the confined passage 89 formed between the arcuate confining surface 73 of the exit shoe assembly and the outer surface of the retarding roller. When the fabric enters the upper extremity of the confined retarding passage 89, it immediately assumes the surface speed of the retarding roller 32, which is controlled, by the variable speed mechanism 39, to be variably slower than the surface speed of the feeding roller 30, perhaps by as much as 15–25% in the case of some fabrics, less perhaps with others, according to the requirements of a particular fabric construction. Under steady state conditions, the change in speed of the fabric, from the feeding speed to the retarding speed, occurs principally at the entrance of the confinement zone defined by the surfaces 66, 75. Immediately thereafter, the fabric has a predetermined dwell time in the confinement zone, during which it is exposed to heat and confinement.

When operating the apparatus of the invention, it is desired to operate with minimum confining pressure in the thickness direction in the confinement zone. However, a complete absence of confining pressure and/or too little confining pressure can cause fabric to take on a "creped" appearance, rather than a smooth but compressively shrunk condition. Initially, therefore, the thickness of the confinement zone is adjusted (by the handwheel 54 and rods 53) to be slightly greater than optimum, to induce some degree of creping, and the condition of the processed fabric is observed. As long as any creping is observed, the thickness of the confinement zone is gradually decreased by manipulation of the handwheel until the creping just disappears.

In the illustrated apparatus, the surface of the retarding roll is formed with a layer 91 of elastomeric material, which typically may be about one quarter inch thick. It may, however, be formed of metal with a roughened surface. The retarding roll is drawn toward the confining surface 73 with a limited amount of pressure, exerted by the fluid actuators 37, under controlled pressure via a variable pressure regulator 92. The net applied force need be sufficient only to establish effective frictional contact with the fabric discharged from the confinement zone so as to achieve positive gripping action on the fabric. Experience indicates that minimal contact pressures are required for this purpose, as in the case of the contact pressures necessary with respect to the feeding shoe assembly with respect to the feeding roller. If necessary or desirable, adjustable limit stops (not shown) may be provided to limit the closing movement of the retarding roller toward the confining surface 73 of the lower blade. In a normal operating configuration, the feeding and retarding rolls are separated by a distance just slightly greater than the thickness of the zone-forming blades 46, 71, as is evident in FIG. 2.

In the processing of most fabrics, the incoming fabric is relatively warm and moist from the application of steam at the steam boxes 20, 21. In addition, means advantageously are provided for heating of at least the feeding roller 30 and the feeding shoe assembly 44. In accordance with features of the existing, prior equipment, the entry shoe assembly 44 may advantageously be heated by means of an electric heater associated with the shoe body 45. The feeding roller 30 is heated internally by means of steam or heated oil, for example. Desirably, provisions are made for controlling the heating media to provide for different temperatures between the feeding roller 30 and the feeding shoe assembly 44.

Remarkable and surprising results have been achieved with the apparatus of the invention. Among other things, fabrics that heretofore were compressively treated in two stations can now be treated in a single station, and even more effectively than heretofore. In this respect, while there exist in the prior art types of equipment that process tubular knitted fabric in a single station, most such machines and processes known to the applicant are very limited in their capacity to impart preshrinkage control. The method and apparatus of the heretofore known Eugene Cohn et al. patents have been outstandingly unique in their ability to impart high degrees of compressive shrinkage, i.e., 25% and above. In such cases, however, it has been appropriate to utilize two station machines in an effort to equalize opposite side surface appearance, and even then, there have been limitations with respect to certain types of sensitive fabrics. With the present apparatus, by contrast, it is possible to impart 25% and more compressive shrinkage in a single station machine, with a highly acceptable level of opposite side surface appearance. This represents a remarkable advance over procedures now available to the industry.

A very significant aspect of the invention, of course, is the fact that an angular confinement zone separates the respective feeding and retarding rollers by a short distance significantly greater than the thickness of the fabric. As a result, the feeding and retarding rolls do not simultaneously contact the fabric at the same point on opposite sides with surfaces travelling at different speeds. Nor is the fabric subjected to wrenching reversals of direction during the compressive shrinkage procedure. The fabric is advanced through the feeding zone with a minimum of confining pressure and abrasion, passes through the confining zone with virtually symmetrical conditions on its opposite surfaces, and is engaged thereafter in a retarding zone in which there is effectively no slippage of the fabric even though it is confined by minimum pressures.

The lack of slippage of the fabric against the feeding and retarding rollers in the procedure of the invention is evidenced by the fact that the retained compressive shrinkage bears a direct and close relationship to the speed differential between the respective rollers. In other words, a roller speed differential of 25% results in processed fabric having an imparted compressive shrinkage of 25% in normal operations.

Another surprising and highly beneficial result of the new apparatus is derived from the fact that the finished, compressively shrunk fabric typically is of the same thickness after treatment as before. On a conventional two station compactor, the treated fabric may be 15% to 25% thinner in some cases, because of the necessity to compress the fabric substantially in the thickness direction during processing. With the procedure and apparatus of the present invention, the fabric is treated very gently throughout, as evidenced by the greater finished thickness. This enables significantly superior results to be derived in the treatment of sensitive fabrics, for example.

The apparatus of the invention is uniquely well suited for processing of tubular knitted fabrics in a single station machine, because there is a minimum of differential action between opposite surfaces of the fabric being processed in two-layer form. There is thus an absolute minimum of opportunity for two-sidedness to occur in the fabric. Although it is of course necessary in the apparatus of the invention for fabric to slide along the confining surfaces of the feeding and retarding shoes, it is possible with the apparatus of the present invention to maintain contact pressures at extremely low levels, so that even sensitive fabrics are processed delicately and with minimum degradation of the finished appearance sought by the customer.

An included benefit of being able to process fabric in a single station and using low contact pressures is significantly lower power requirements. The floor-space occupied by the equipment is also significantly reduced by elimination of need for a second stage of compressive shrinkage.

In the specifically illustrated apparatus, the compressive treatment zone is disposed at an angle of 45 degrees to the adjacent roller surfaces. The maximum and minimum limits of such angle have not been fully determined, although it is believed are the basis of investigations that the angle should not be less than about 30 degrees nor more than about 60 degrees with respect to the adjacent surface of the feed roller.

The apparatus of the invention is of course applicable to fabrics other than tubular knitted fabrics, and would be applicable to open width knitted fabrics, for example, various compressible gauze materials and the like. The apparatus of the invention is also suitable for so-called "wet compacting", where fabric is dyed or otherwise treated with a processing liquid, extracted to a level of 75%-80% moisture, for example, and then subjected to compressive shrinkage treatment. With some prior art apparatus, this has been difficult because the relatively high pressures required to be applied to the fabric resulted in unwanted extraction of liquids at the compressive shrinkage treatment station. With the apparatus of the present invention, the unusually low contact pressures required to carry out the process greatly minimize or eliminate altogether unwanted extraction of treating liquid during the compressive treatment phase.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Compressive pre-shrinking apparatus for knitted fabrics and the like comprising
   (a) a fabric feeding roller,
   (b) an entry-side fabric confining shoe generally conforming to a surface portion of said feeding roller and defining therewith a confined entry path for the controlled advancement of fabric by said feeding roller,
   (c) means for adjustably relatively positioning said entry-side confining shoe and fabric roller to bear with limited controlled pressure upon fabric confined in said entry path,
   (d) a fabric retarding roller mounted for rotation closely adjacent and parallel to said feeding roller,
   (e) the axes of said feeding and retarding rollers defining a reference plane passing through the region at which said feeding and retarding rollers most closely approach each other,
   (f) said rollers, at said reference plane, being spaced apart a distance substantially greater than the thickness of said fabric,
   (g) an exit-side confining shoe conforming to a surface portion of said retarding roller and defining therewith an exit path for the controlled discharge of fabric by said retarding roller,
   (h) means for adjustably relatively positioning said exit-side confining shoe and said retarding roller to bear with limited controlled pressure upon fabric confined in said exit path,
   (i) said confining shoes having blade-like extensions projecting toward each other and into the space between said rollers and meeting in the general region of the plane containing the axes of said rollers,
   (j) means comprising confronting surfaces of said blade-like extensions engaging opposite surfaces of said fabric and forming a confinement zone for the confined and controlled passage of said fabric during its transit from said entry path to said exit path, and
   (k) means for controllably and resiliently urging said blade-like extensions toward each other to controllably confine said fabric during its transit from said entry path to said exit path.

2. Compressive pre-shrinking apparatus according to claim 1, further characterized by
   (a) said confinement zone being disposed at an angle of about 30 to 60 degrees to said plane.

3. Compressive pre-shrinking apparatus according to claim 2, further characterized by
   (a) one of said confining shoes being mounted for limited pivoting movement about the axis of its cooperating roller whereby the thickness of said confinement zone may be controllably increased or decreased.

4. Compressive pre-shrinking apparatus according to claim 1, further characterized by
   (a) said means for adjustably relatively positioning said confining shoes and said rollers comprising fluid actuator means and adjustable pressure regulating means therefor.

5. Compressive pre-shrinking apparatus according to claim 1, further characterized by
   (a) said means for controllably and adjustably urging said blade-like extensions relatively toward each other comprising air actuator means and adjustable pressure regulator means, whereby the fabric in said confinement zone is maintained under sufficient pressure in the thickness direction to avoid crimping of said fabric during passage thereof through said zone.

6. Compressive pre-shrinking apparatus according to claim 1, further characterized by
   (a) separate and independently controllable means being provided for heating said feeding roller and said entry-side confining shoe.

7. Compressive pre-shrinking apparatus according to claim 1, further characterized by
   (a) said feeding roller being of metal construction and having a roughened outer surface for effectively positive gripping of said fabric.

8. Compressive pre-shrinking apparatus according to claim 7, further characterized by
   (a) said retarding roller having a resilient outer surface.

9. Compressive pre-shrinking apparatus for knitted fabrics and the like comprising
   (a) a fabric feeding roller,
   (b) an entry-side fabric confining shoe generally conforming to a surface portion of said feeding roller and defining therewith a confined entry path for the controlled advancement of fabric in a substantially positive manner by said feeding roller,
   (c) means for adjustably relatively positioning said entry-side confining shoe and fabric feeding roller to bear with limited controlled yieldable pressure upon fabric confined in said entry path,
   (d) a fabric retarding roller mounted for rotation closely adjacent and parallel to said feeding roller, (e) the axes of said feeding and retarding rollers defining a reference plane passing through the region at which said feeding and retarding rollers most closely approach each other, (f) said rollers being separated from each other at said reference plane by a distance substantially greater than the thickness of the fabric being treated, whereby said fabric is not contacted on both sides simultaneously by both of said rollers, (g) an exit-side confining shoe conforming to a surface portion of said retarding roller and defining therewith an exit path for the controlled discharge of fabric in a substantially positive manner by said retarding roller, (h) means for adjustably relatively positioning said exit-side confining shoe and said retarding roller to bear with limited controlled yieldable pressure upon fabric confined in said exit path, (i) said confining shoes having blade-like extensions projecting into the space between said rollers and meeting in the general region of the plane containing the axes of said rollers, and (j) means comprising confronting upper and lower end surfaces of said blade-like extensions engaging opposite surfaces of the fabric and forming a confinement zone for the confined and controlled passage of said fabric during its transit from said entry path to said exit path, and (k) resilient, controllably adjustable fluid actuator means urging said blade-like extensions toward each other to maintain fabric, transiting between said entry and exit paths under limited controlled pressure in the thickness direction to prevent creping of said fabric in said confinement zone.

10. Compressive pre-shrinking apparatus according to claim 9, further characterized by (a) said compressive shrinkage zone being disposed at such an angle to said plane that said fabric is caused to be redirected abruptly through an angle of between 30 and 60 degrees.

11. Compressive pre-shrinking apparatus according to claim 10, further characterized by (a) at least one of said confining shoes being mounted for limited pivoting movement generally about the axis of its cooperating roller for controlling the thickness of said confinement zone.

12. Compressive pre-shrinking apparatus according to claim 9, further characterized by (a) said feeding roller being of metal construction and having a roughened outer surface for effectively positive gripping of said fabric, and (b) said retarding roller having a resilient outer surface.

13. Apparatus according to claim 1, further characterized by (a) air actuator means for controllably and yieldably urging said entry-side confining shoe toward the surface of said feeding roller, and (b) second fluid actuator means for controllably urging said retarding roller toward said exit side confining shoe.

14. Apparatus according to claim 15, further characterized by (a) said retarding roller having a resilient surface.

* * * * *